US005667882A

United States Patent [19]

Fourezon et al.

[11] Patent Number: 5,667,882

[45] Date of Patent: Sep. 16, 1997

[54] TEXTILE REINFORCEMENT WHICH CAN BE USED FOR PRODUCING COMPOSITE MATERIALS

[75] Inventors: André Fourezon; Thierry Klethi, both of Le Cheylard, France

[73] Assignee: Etablissements les Fils d'Auguste Chomarat et Cie, France

[21] Appl. No.: 654,750

[22] Filed: May 29, 1996

[30] Foreign Application Priority Data

Jun. 2, 1995 [FR] France ..... 95 06798

[51] Int. Cl.[6] ..... B32B 15/00

[52] U.S. Cl. ..... 442/388; 442/415; 442/416

[58] Field of Search ..... 428/285, 287, 428/297, 298, 300, 284, 286

[56] References Cited

U.S. PATENT DOCUMENTS 3,338,777 8/1967 Irwin et al. .

FOREIGN PATENT DOCUMENTS 0435783 7/1991 European Pat. Off. .
1575765 7/1969 France .
2646442 11/1990 France .

*Primary Examiner*—James J. Bell
*Attorney, Agent, or Firm*—Parkhurst Wendell and Burr, L.L.P

[57] ABSTRACT

A fibrous structure including a carded web of fibers that have higher individual-fiber linear density and which exhibit a spring characteristic. The web is sprayed with glass fibers or continuous glass filaments that randomly spread out flat on the web, and the web is subsequently needle-punched through a surface thereof to drive the glass fiber or glass filaments through the thickness of the web such that the glass fibers or glass filaments emerge through an opposite surface of the web.

10 Claims, No Drawings

TEXTILE REINFORCEMENT WHICH CAN BE USED FOR PRODUCING COMPOSITE MATERIALS

The invention relates to an improvement made to textile reinforcements used for producing composite materials, in particular articles based on a resin (polyester or other resins) which are reinforced with a reinforcing textile web.

Depending on the desired applications and properties, the reinforcing structures used hitherto in the field of composites are, for example, fabrics, textile meshes, filamentary webs which are unidirectional, bidirectional, etc., or a combination of such elements.

In French Patent 2,646,442, the Applicant proposed a textile reinforcement which is particularly suited to producing very thick reinforcements, this thickness characteristic being necessary when it is desired to produce elements such as vehicle bodies, yachts, storage tanks, etc., which must exhibit high rigidity. Such a reinforcement consists of at least two plies of textile reinforcement proper, arranged on either side of a central ply giving thickness to said material, and in said reinforcement said central ply consists of a web based on man-made fibers, of high individual-fiber linear density, which have received, before they have Seen put into the form of webs, a treatment imparting to them a permanent wave or crimp, the various plies being joined together, especially by sewing/knitting.

Such a complex is entirely satisfactory with regard to the mechanical properties exhibited by the composite structures which it enables to be produced.

Moreover, it is particularly suited to producing structures of complex shape which are obtained by molding, for example using the techniques called "injection-compression molding" or "vacuum molding".

However, for some applications it has been observed that there could be a risk of delamination in the region forming the interface between the central ply giving thickness to the material and the surface plies which themselves give the mechanical properties.

Now, a simple and effective solution has been found which enables the risk of delamination to be virtually completely eliminated, and it is this solution which forms the subject of the present invention.

In general, the invention therefore relates to an improvement made to the fibrous webs intended to form the central ply giving thickness to a complex textile reinforcement involved in the production of a composite material, said fibrous webs being based on fibers, of high individual-fiber linear density, exhibiting a "spring" effect.

The material according to the invention is one wherein the conformation in the form of a web of said fibers of high linear density is produced by carding and wherein, immediately after producing the carded web, the surface of the latter is continuously sprayed with glass fibers or continuous glass filaments which spread out flat randomly in all directions, the assembly then being subjected to a mechanical treatment of needle punching which drives in said glass fibers or glass filaments through the entire thickness of the web of man-made fibers, in such a way that the glass fibers or glass filaments emerge on the opposite face, the structure formed being subsequently taken up in the form of a wound package.

In order to produce the carded fibrous web, it is possible to use either man-made fibers having a high individual-fiber linear density, such as polyester, polyamide, polyethylene or polypropylene fibers, or other such fibers, which have received, before they are put into the form of a web, a treatment imparting to them a permanent wave or crimp conferring the "spring" effect, this treatment possibly being, for example, a stuffing treatment, or vegetable fibers, such as flax, sisal, jute or other such fibers.

By high linear density is meant fibers whose linear density is generally between 20 and 200 dtex, and whose chopped length for the man-made fibers is generally between 40 and 120 mm, this length possibly being optionally greater in the case of vegetable fibers.

It would be conceivable to use finer fibers, but then this would be to be detriment of the quality of the composite material formed since the fibrous web would then have a higher web density which would disrupt the progress of the resin during the production of the composite material.

It is also conceivable to use fibers having a linear density greater than 200 dtex. However, in such a case, the carding operation is difficult to carry out and, above all, the carded web obtained may lack homogeneity.

Moreover, the basis weight of said carded web will advantageously be between 150 g/m$^2$ and 400 g/m$^2$. The reason for this is that, for a basis weight of less than 150 g/m$^2$, the complex lacks integrity and uniformity while a basis weight of greater than 400 g/m$^2$ leads to thick products which are not justified in practice.

The thickness of the central web will, in general, be between 3 and approximately 10 mm.

The sprayed glass fibers embedded within the web are fibers having a chopped length of at least 10 mm, their linear density possibly varying from 15 to 160 tex. These fibers are sprayed to an amount of 50 to 200 g/m$^2$. There is no upper limit in the length of the glass fibers, which may consist of continuous filaments.

The invention and the advantages which it provides will, however, be better understood by means of the embodiment which follows, this being given hereinbelow by way of indication but implying no limitation.

EXAMPLE

A material in accordance with the invention is produced on a production line comprising, in succession, a conventional carding machine, a belt for picking up the carded web formed, above which belt is placed a system for spraying chopped glass fibers, a conventional mechanical needle puncher equipped with needles whose barbs are oriented in only one direction in order to drive in the fibers only during the penetration phase, said needle puncher being followed by a system for taking up the web formed.

In such an installation, a carded web is formed from polypropylene fibers, of 110 dtex fiber linear density—chopped to 90 mm and crimped by stuffing, the web weighing, on leaving the carding machine, 250 g/m$^2$.

Since the web is held flat on the conveyor belt, its surface is sprayed with glass fibers having a linear density of 25 tex, the chopped length being 50 mm, to an amount of 150 g/m$^2$.

The rate at which the web is pulled off is 4 m/mm.

The assembly subsequently passes into a conventional needle puncher adjusted to apply 40 punches/cm$^2$.

On leaving the production line, the complex formed weighs 400 g/m$^2$ and has a thickness of about 8 mm.

Such a fibrous structure may be used as the central ply intended to give thickness to the entire complex textile reinforcing structure of laminated material, the textile reinforcements proper, which are possibly arranged on either side of such a structure, are combined with the latter by any appropriate means, especially by a sewing/knitting, needle punching or adhesive bonding operation.

The additional reinforcements may be of any conventional type, namely, for example:

parallel yarns which are touching or spaced apart;

bidirectional Webs or fibrous webs, or indeed even fabrics and/or combinations of such elements.

It has been observed that such a material, when it is used to produce a composite structure by replacing the central ply, such as that described in FR-A-2,646,442, made it possible to eliminate the risk of delamination virtually completely as well as also to improve the flexural, rigidity and aging-withstand properties.

We claim:

1. A fibrous structure, comprising:

a carded web of fibers that have high individual-fiber linear density and which exhibit a spring characteristic, wherein the carded web (1) is sprayed with glass fibers or continuous glass filaments that randomly spread out flat on the carded web, and (2) is subsequently needle-punched through a surface of the carded web to drive the glass fibers or glass filaments through the thickness of the carded web such that the glass fibers or glass filaments emerge through an opposite surface of the carded web.

2. The fibrous structure of claim 5, wherein said fibers are man-made.

3. The fibrous structure of claim 2, wherein said fibers are formed of a material selected from the group consisting of polyester, polyamide, polyethylene and polypropylene, said fibers being treated to impart a permanent wave or crimp before forming the carded web.

4. The fibrous structure of claim 1, wherein said fibers are comprised of a vegetable material.

5. The fibrous structure of claim 4, wherein said fibers are formed of a material from the group consisting of flax, sisal and jute.

6. The fibrous structure of claim 2, wherein said fibers have a chopped length between 20 and 120 mm.

7. The fibrous structure of claim 4, wherein said fibers have a chopped length of at least 20 mm.

8. The fibrous structure of claim 1, wherein the fibrous structure includes said glass fibers, the glass fibers having a chopped length of at least 10 mm, and a linear density between 15 and 160 tex.

9. The fibrous structure of claim 1, wherein the fibrous structure includes glass filaments, the glass filaments having a linear density between 15 and 160 tex.

10. The fibrous structure of claim 1, further comprising first and second opposing textile reinforcement layers attached to opposite surfaces of the carded web, whereby the carded web forms a central ply of the fibrous structure.

* * * * *